US006316985B1

(12) United States Patent
Kobayashi et al.

(10) Patent No.: US 6,316,985 B1
(45) Date of Patent: Nov. 13, 2001

(54) SUBSTRATE VOLTAGE GENERATING CIRCUIT PROVIDED WITH A TRANSISTOR HAVING A THIN GATE OXIDE FILM AND A SEMICONDUCTOR INTEGRATED CIRCUIT DEVICE PROVIDED WITH THE SAME

(75) Inventors: Mako Kobayashi; Akira Yamazaki, both of Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/270,053

(22) Filed: Mar. 16, 1999

(30) Foreign Application Priority Data

Oct. 5, 1998 (JP) ..... 10-282462

(51) Int. Cl.[7] ..... G05F 1/10; G05F 3/02
(52) U.S. Cl. ..... 327/536
(58) Field of Search ..... 327/534, 535, 327/536, 537

(56) References Cited

U.S. PATENT DOCUMENTS 4,628,214 12/1986 Leuschner ..... 327/537
5,023,465 * 6/1991 Douglas et al. ..... 365/203
5,357,416 * 10/1994 Kitano et al. ..... 363/60
5,673,232 * 9/1997 Furutani ..... 365/226
5,831,470 * 11/1998 Park et al. ..... 327/536
5,909,141 * 6/1999 Tomishima ..... 327/536

FOREIGN PATENT DOCUMENTS 08-149801 6/1996 (JP) .

OTHER PUBLICATIONS

An Efficient Back–Bias Generator with Hybrid Pumping Circuit for 1.5V DRAMs, Y. Tsukikawa eta al., 1993 Symposium on VLSI Circuits Digests of Technical papers, pp. 85–86.

"ULSI DRAM Technology", Kabushiki Kaisha Science Forum, first edition published Sep. 25, 1992, pp. 65–67.

* cited by examiner

*Primary Examiner*—Terry D. Cunningham
*Assistant Examiner*—Quan Tra
(74) *Attorney, Agent, or Firm*—McDermott, Will & Emery

(57) ABSTRACT

A semiconductor integrated circuit device includes an oscillator generating a clock signal and a charge pump circuit. The charge pump circuit includes capacity elements and an output transistor. The capacity element boosts a voltage on a boost node. The transistor (clamp circuit) clamps the voltage level on the boost node to a constant value. The capacity element controls the gate voltage of the output transistor. The clamp circuit is used to suppress a voltage applied to the transistors and the MOS capacity element, and suppresses generation of hot carriers.

15 Claims, 12 Drawing Sheets

SUBSTRATE VOLTAGE GENERATING CIRCUIT PROVIDED WITH A TRANSISTOR HAVING A THIN GATE OXIDE FILM AND A SEMICONDUCTOR INTEGRATED CIRCUIT DEVICE PROVIDED WITH THE SAME

BACKGROUND OF THE INVENTION

1. Field of the Invention

The present invention relates to a substrate voltage generating circuit and a semiconductor integrated circuit device, and particularly relates to a substrate voltage generating circuit, which uses transistor having thin gate oxide films, as well as a semiconductor integrated circuit device.

2. Description of the Background Art

Present dynamic random access memories, which will be referred to as "DRAMs" hereinafter, use constant power supply voltages. However, the DRAM is internally provided with a substrate voltage generating circuit, which is arranged on a chip and generates a negative voltage for the purposes of (1) preventing a pn junction in the chip from being forwardly biased in a minimum manner, (2) reducing a change in threshold voltage of a MOS transistor due to a substrate effect, (3) increasing a threshold voltage of a parasitic MOS, (4) reversely biasing and thereby reducing a junction capacity, and others.

A structure of a substrate voltage generating circuit 700 in the prior art will be described below with reference to FIG. 16. Referring to FIG. 16, a substrate voltage generating circuit 700 includes a ring oscillator 702 and a charge pump 704.

Ring oscillator 702 includes inverters 71, 72 and 73. Charge pump circuit 704 includes a capacity element C70 and a PMOS transistor Q70. Capacity element C70 receives a clock signal issued from oscillator 702. PMOS transistor Q70 is connected between capacity element C70 and a substrate voltage output node OUT. A charge pump operation is repeated based on the output of oscillator 702 so that electrons (VBB) are supplied to a substrate (not shown).

In recent years, the power supply voltages have been increasingly lowered. This is because lowering of the operation voltages is unavoidably required due to lowering of transistor breakdown voltages, which is caused by miniaturization of transistors. Accordingly, it is demanded to provide a charge pump circuit of a boost type, which uses a low power supply voltage and has high pump efficiency.

In particular, a large substrate current occurs during accessing of a device so that such a circuit is required that supplies a large current commensurate with it and provides a predetermined negative voltage (substrate voltage) VBB.

Meanwhile, a gate oxide film thickness tox of transistors has been reduced in accordance with scaling of devices. If a charge pump circuit of a boost type is used, an intensity of an electric field applied to a channel of a transistor increases. This results in extreme increase in energy of carriers moving through the channel, and therefore extremely increases a possibility of generation of hot carriers. Hot carriers thus generated cause shifting of a threshold voltage and lowering of a mutual conductance, and therefore causes a problem that device characteristics are deteriorated over time. This impairs the reliability.

SUMMARY OF THE INVENTION

Accordingly, an object of the invention is to provide a substrate voltage generating circuit, which has high pump efficiency ensuring reliability even if transistors having thin gate oxide films are used, as well as a semiconductor integrated circuit device including the same.

A substrate voltage generating circuit according to the invention includes a voltage output terminal issuing a substrate voltage; a voltage supply circuit for supplying a voltage to the voltage output terminal in response to a clock signal; a switch circuit arranged between the voltage supply circuit and the voltage output terminal; a drive circuit including a boost node and a first capacity element boosting a voltage on the boost node in response to the clock signal; and provided for turning on/off the switch circuit with the voltage on the boost node; and a clamp circuit for clamping the level of the voltage on the boost node to a constant level.

As a major advantage, the invention can provide the substrate voltage generating circuit of a boost type, in which the boost level can be clamped to a predetermined value, and thereby a maximum electric field applied to a gate oxide film of a transistor can be suppressed. As a result, the circuit can generate a substrate voltage with high pump efficiency even when the power supply voltage is low, and can have high reliability.

In particular, an output transistor may be driven by pump operations in two stages. At this time, a capacity ratio between two capacity elements is controlled. Thereby, the boost level can be suppressed.

According to another aspect, a substrate voltage generating circuit includes a voltage output terminal issuing a substrate voltage; a voltage supply circuit for supplying a voltage to the voltage output terminal in response to a clock signal having an amplitude corresponding to a power supply voltage; a switch circuit arranged between the voltage supply circuit and the voltage output terminal; a drive circuit including a changing circuit for changing the clock signal having the amplitude corresponding to the power supply voltage into a clock signal having an amplitude corresponding to a boosted power supply voltage produced by boosting the power supply voltage, and a capacity element receiving the clock signal having the amplitude corresponding to said boosted power supply voltage, and provided for turning on/off said switch circuit based on a pump operation of said capacity element.

According to another advantage of the invention, the clock signal having an amplitude of the boosted power supply voltage level may be applied to the capacity element, whereby the charge pump operation can be performed without an influence by a change in an external power supply voltage.

In particular, the boosted power supply voltage level may be smaller than double the power supply voltage level. Thereby, it is possible to suppress the maximum electric field applied to the gate oxide film of the transistor. As a result, the circuit can generate the substrate voltage with high pump efficiency even when the power supply voltage is low, and can have high reliability.

According to still another aspect of the invention, a semiconductor integrated circuit device includes a clock generating circuit for generating a clock signal, a voltage output terminal issuing a substrate voltage; a voltage supply circuit for supplying a voltage to the voltage output terminal in response to the clock signal; a switch circuit arranged between the voltage supply circuit and the voltage output terminal; a drive circuit including a boost node and a first capacity element boosting a voltage on the boost node in response to the clock signal; and provided for turning on/off the switch circuit with the voltage on the boost node; and a clamp circuit for clamping the level of the voltage on the boost node to a constant level.

As another advantage of the invention, the boost level can be clamped to a predetermined value in a substrate voltage generating circuit of a boost type, and thereby a maximum electric field applied to a gate oxide film of a transistor in a charge pump can be suppressed. As a result, the circuit can generate a substrate voltage with high pump efficiency even when the power supply voltage is low, and can have high reliability.

In particular, an output transistor may be driven by pump operations in two stages. At this time, a capacity ratio between two capacity elements is controlled. Thereby, the boost level can be suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[Embodiment 1]

Figure 1:
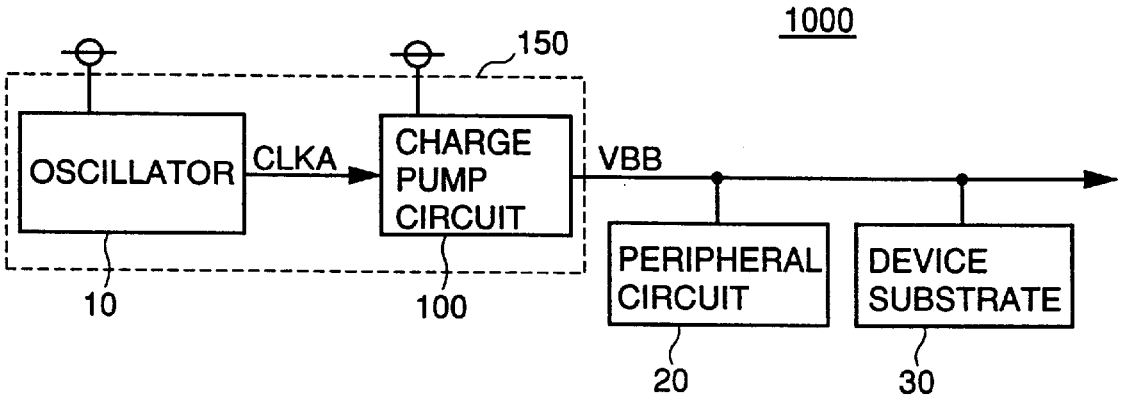
FIG. 1 is a block diagram showing a structure of a major portion of a semiconductor integrated circuit device 1000 of an embodiment 1 of the invention.

A semiconductor integrated circuit device and a substrate voltage generating circuit of an embodiment 1 of the invention will be described below with reference to FIG. 1. A semiconductor integrated circuit device 1000 shown in FIG. 1 includes a substrate voltage generating circuit 150, a peripheral circuit 20 and a device substrate 30. Substrate voltage generating circuit 150 includes an oscillator 10 and a charge pump circuit 100.

When a power supply voltage VCC is supplied, oscillator 10 operates to generate a clock signal CLKA. Oscillator 10 oscillates independently of an externally supplied external control signal. Charge pump circuit 100 generates a substrate voltage VBB in response to clock signal CLKA sent from oscillator 10. Substrate voltage VBB thus generated is supplied to peripheral circuit 20 and device substrate 30.

Figure 2:
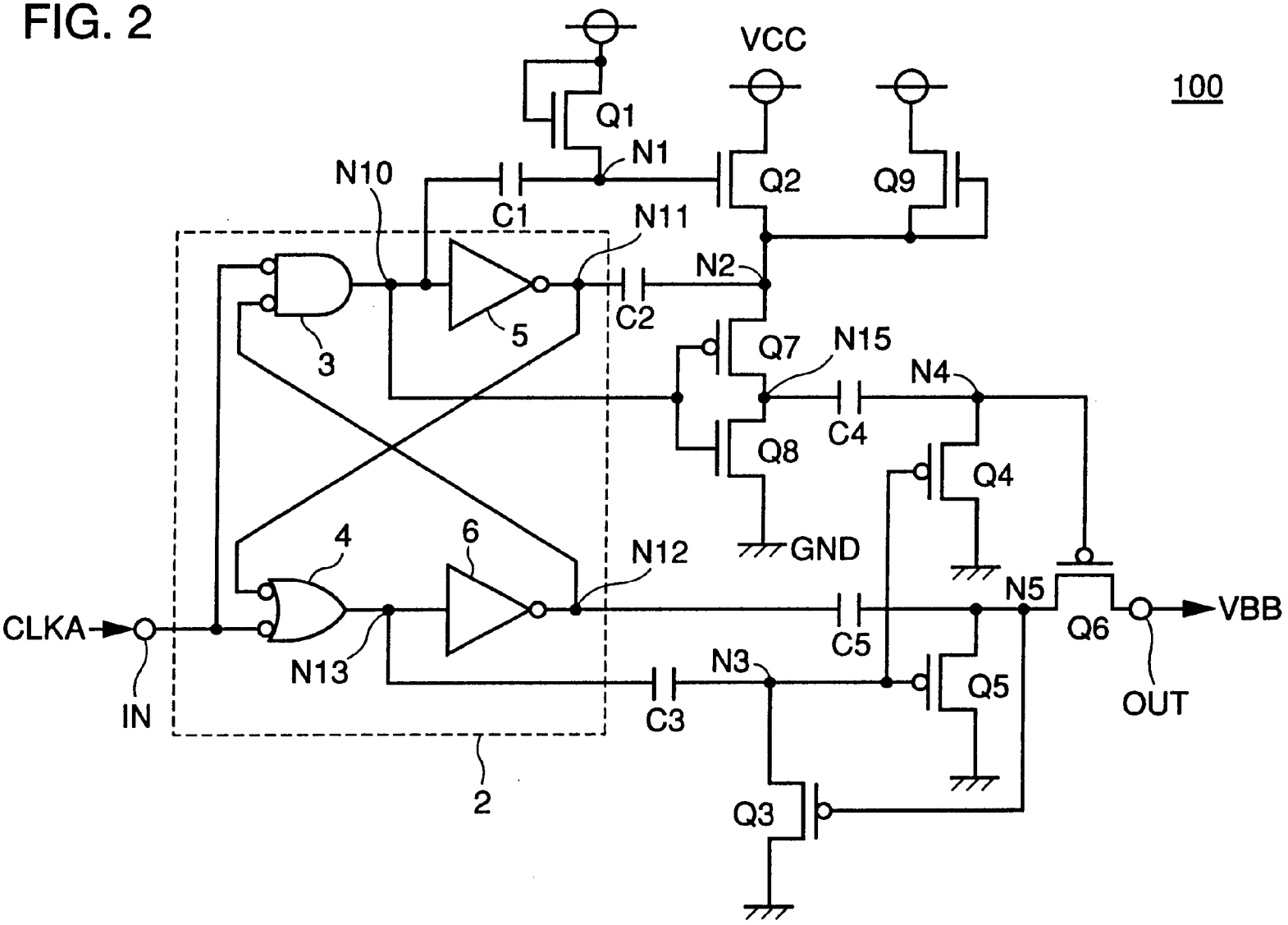
FIG. 2 shows by way of example a specific structure of a charge pump circuit 100 shown in FIG. 1.

An example of a specific structure of charge pump circuit 100 shown in FIG. 1 will be described below with reference to FIG. 2. Referring to FIG. 2, charge pump circuit 100 includes a timing control circuit 2, capacity elements C1–C5, and transistors Q–Q9.

Capacity elements C1–C5 are formed of, e.g., MOS capacitors, respectively. Transistors Q3–Q7 are PMOS transistors, respectively. Transistors Q1, Q2, Q8 and Q9 are NMOS transistors, respectively.

Timing control circuit 2 responds to clock signal CLKA received on its clock input node IN, and supplies a voltage to capacity elements C1–C5 in accordance with predetermined timing. Timing control circuit 2 includes logic gates 3 and 4 as well as inverters 5 and 6. Clock signals are issued from an output node N10 of logic gate 3, an output node N11 of inverter 5, an output node N12 of inverter 6 and an output node N13 of logic gate 4.

Capacity element C1 is connected between nodes N10 and N1. Node N1 is connected to diode-connected transistor Q1. Node N1 is also connected to a gate electrode of transistor Q2.

Capacity element C2 is connected between node N11 and a node N2 (boost node). Transistor Q2 is connected between power supply voltage VCC and node N2. Transistor Q9 which is a clamp circuit is connected between power supply voltage VCC and node N2, and has a gate electrode connected to node N2. Transistor Q9 clamps the voltage on node N2.

Transistors Q7 and Q8 are connected in series between node N2 and ground voltage GND. Each of transistors Q7 and Q8 has a gate electrode connected to node N10.

Capacity element C4 is connected between a connection node N15, which is formed between transistors Q7 and Q8, and a node N4. Transistor Q4 is connected between node N4 and ground voltage GND, and has a gate electrode connected to a node N3. Node N4 is further connected to a gate electrode of output transistor Q6.

Capacity element C5 is connected between nodes N12 and N5. Transistor Q6 is connected between node N5 and a substrate voltage output node OUT. Transistor Q5 is connected between node N5 and ground voltage GND, and has a gate electrode connected to node N3.

Capacity element C3 is connected between nodes N13 and N3. Transistor Q3 is connected between node N3 and ground voltage GND, and has a gate connected to node N5.

Capacity element C1 forcedly raises the voltage on node N1 which is clamped by transistor Q1, and controls the gate voltage of transistor Q2. Capacity element C2 raises the voltage supplied to node N2 through transistor Q2 which is turned on. Transistor Q9 clamps the voltage on node N2.

Capacity element C3 lowers the voltage on node N3 which is clamped to ground voltage GND by transistor Q3, and clamps the gate voltages on transistors Q4 and Q5.

Capacity element C4 performs the pump operation based on the voltage level on node N2. Capacity element C2 has a larger capacity than capacity element C4. Capacity element C4 lowers the voltage on node N4 which is clamped to ground voltage GND by transistor Q4, and controls the gate voltage on output transistor QG.

Capacity element C5 supplies charges to node N5, which is clamped to the ground voltage by transistor Q5. These charges are supplied to the substrate through transistor Q6.

Figure 3:
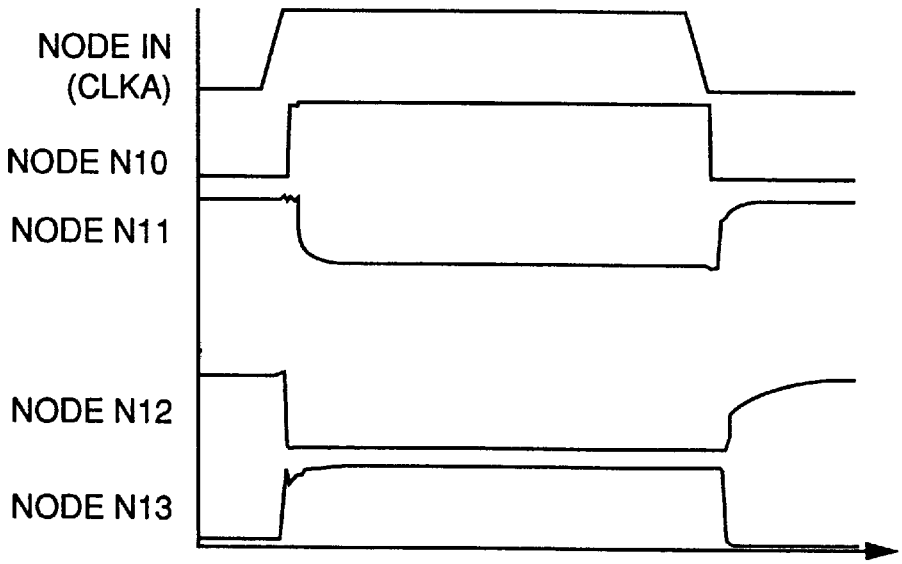
FIGS. 3, 4 and 5 are timing charts showing an operation of the charge pump circuit shown in FIG. 2.
Figure 4:
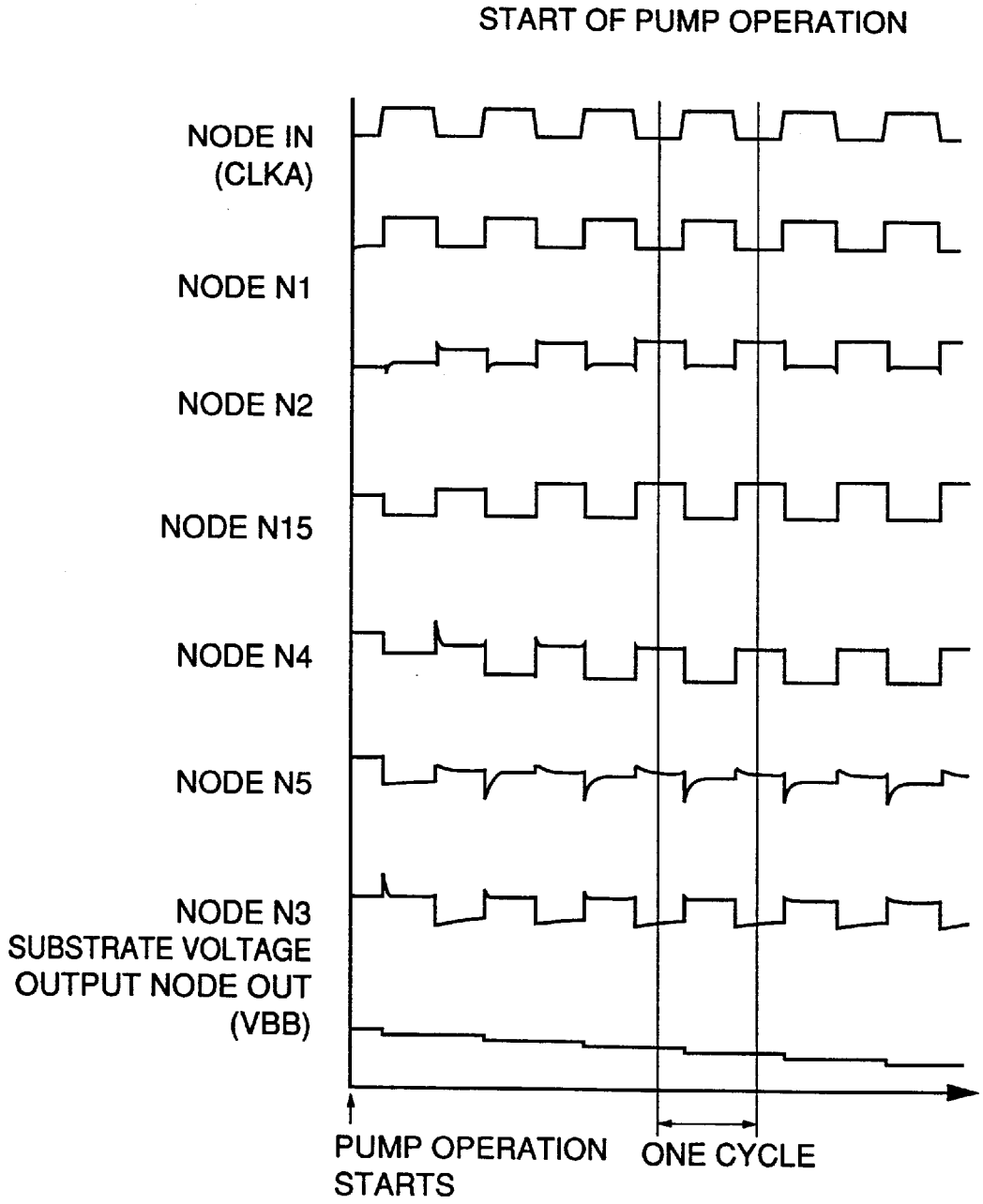
Figure 5:
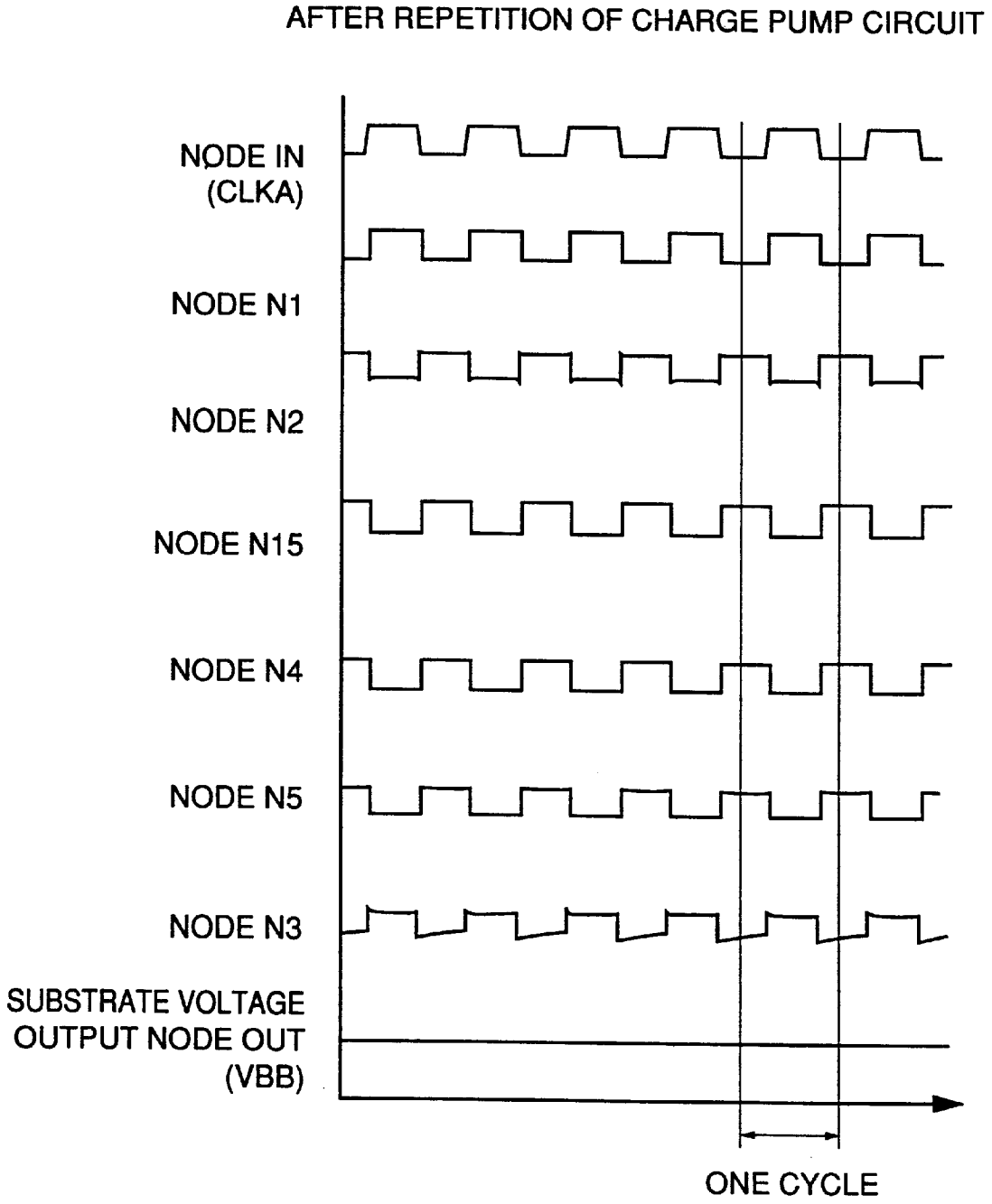

FIGS. 3 to 5 are timing charts showing an operation of charge pump circuit 100 shown in FIG. 2. FIG. 3 shows outputs of timing control circuit 2, FIG. 4 shows voltages on the major nodes immediately after start of the pump operation, and FIG. 5 shows voltages on the major nodes after repetition of the pump operation. The operation of charge pump circuit 100 shown in FIG. 2 will be described below with reference to FIGS. 1 to 5.

The timing control circuit 2 controls timing of the pump operation enhancing the charge pump effect. For example, it places a negative voltage on node N5 for preventing reverse flow of electrons from the substrate while the gate of output transistor Q6 is on.

When clock signal CLKA is supplied to clock input node IN, signals of the same phase as clock signal CLKA are issued from nodes N10 and N13, and signals of the phase opposite to that of clock signal CLKA are issued from nodes N11 and N12.

When the charge pump operation starts in response to clock signal CLKA, charges are supplied to node N2, and the amplitude of voltage on node N15 gradually increases.

When transistor Q7 is on and transistor Q8 is off, the voltage on node N2 is applied to capacity element C4. In this state, node N4 is clamped to ground voltage GND by transistor Q4. When transistor Q7 is turned off and transistor Q8 is turned on, a voltage applied to capacity element C4 lowers to ground voltage level GND so that the voltage on node N4 lowers.

When clock signal CLKA changes from ground voltage level GND to power supply voltage level VCC after repetition of the charge pump operation, the voltage on node N1 changes from (VCC−Vthq1) to (2VCC−Vthq1), where Vthq1 represents a threshold voltage of transistor Q1. When the voltage on node N1 attains (2VCC−Vthq1), transistor Q2 is turned on so that the voltage on node N2 attains power supply voltage level VCC.

When clock signal CLKA falls to ground voltage level GND, the voltage on node N1 is switched to (VCC−Vthq1), and transistor Q2 is turned off. The voltage on node N2 tends to rise from the level of power supply voltage VCC to the level of 2VCC. However, transistor Q9 clamps the voltage on node N2 to (VCC+Vthq9), where Vthq9 represents the threshold voltage of transistor Q9. Thereby, the voltage on node N4 changes from (−VCC−Vthq9) to ground voltage level GND.

When node N4 carries a voltage of (−VCC−Vthq9), node N5 carries a voltage of (−VCC). Therefore, when the voltage of (−VCC−Vthq9) on node N4 is applied to the gate electrode of output transistor Q6, charges on node N5 are supplied to substrate voltage output node OUT.

By repeating application of clock signal CLKA, charges are supplied. When the voltage (substrate voltage VBB) on substrate voltage output node OUT goes to (−VCC), supply of charges stops. A threshold voltage Vthq6 of transistor is smaller than or equal to Vthq9 (Vthq6≦Vthq9).

Since the gate voltage of output transistor Q6 (i.e., the voltage on node N4) is sufficiently negative with respect to node N4 and substrate (VBB), substrate voltage VBB is not affected by the threshold voltage of transistor Q6, and attains the substantially same level as the voltage on node N5. Thus, even a low voltage is used for the operation, an intended substrate voltage VBB can be obtained by using charge pump circuit 100.

If threshold voltage Vthq6 of transistor Q6 is larger than Vthq9, supply of charges stops when substrate voltage VBB goes to (−VCC−Vthq9+Vthq6) which is nearly equal to −VCC.

Description will be given on comparison between a circuit not using the clamp circuit (transistor Q9) shown in FIG. 6 and charge pump circuit 100. A circuit shown in FIG. 6, i.e., a charge pump circuit 900 includes timing control circuit 2, MOS capacity elements C1–C5, and transistors Q1–Q8. These are connected in the manner already described with reference to FIG. 2.

When charge pump circuit 900 is supplied with clock signal CLKA, electrons are gradually supplied to the substrate. In this case, when clock signal CLKA falls to ground voltage level GND, the voltage on node N2 changes from power supply voltage level VCC to 2VCC. When clock signal CLKA finally changes from ground voltage level GND to power supply voltage level VCC after repetition of the pump operation, the voltage on node N1 changes from (VCC−Vthq1) to (2VCC−Vthq1). The voltage on node N2 changes from 2VCC to power supply voltage level VCC, and the voltage on node N3 changes from (−VCC) to the ground voltage level GND. The voltage on node N4 changes from ground voltage level GND to (−2VCC), and the voltage on node N5 changes from ground voltage level GND to (−VCC). When substrate voltage output node OUT attains (−VCC), supply of electrons stops.

In charge pump circuit 900, the voltage on node N2 changes from 2VCC to power supply voltage level VCC. Thereby, the voltage on node N4 changes from ground voltage level GND to (−2VCC).

In contrast to the above, charge pump circuit 100 according to the embodiment 1 of the invention operates to change the voltage on node N2 from (VCC+Vthq9) to power supply voltage level VCC, as already described. Thereby, the voltage on node N4 changes from ground voltage level GND to (−VCC−Vthq9). Thus, the amplitudes of voltages on noses N2, N15 and N4 are smaller than that of charge pump circuit 900.

Figure 6:
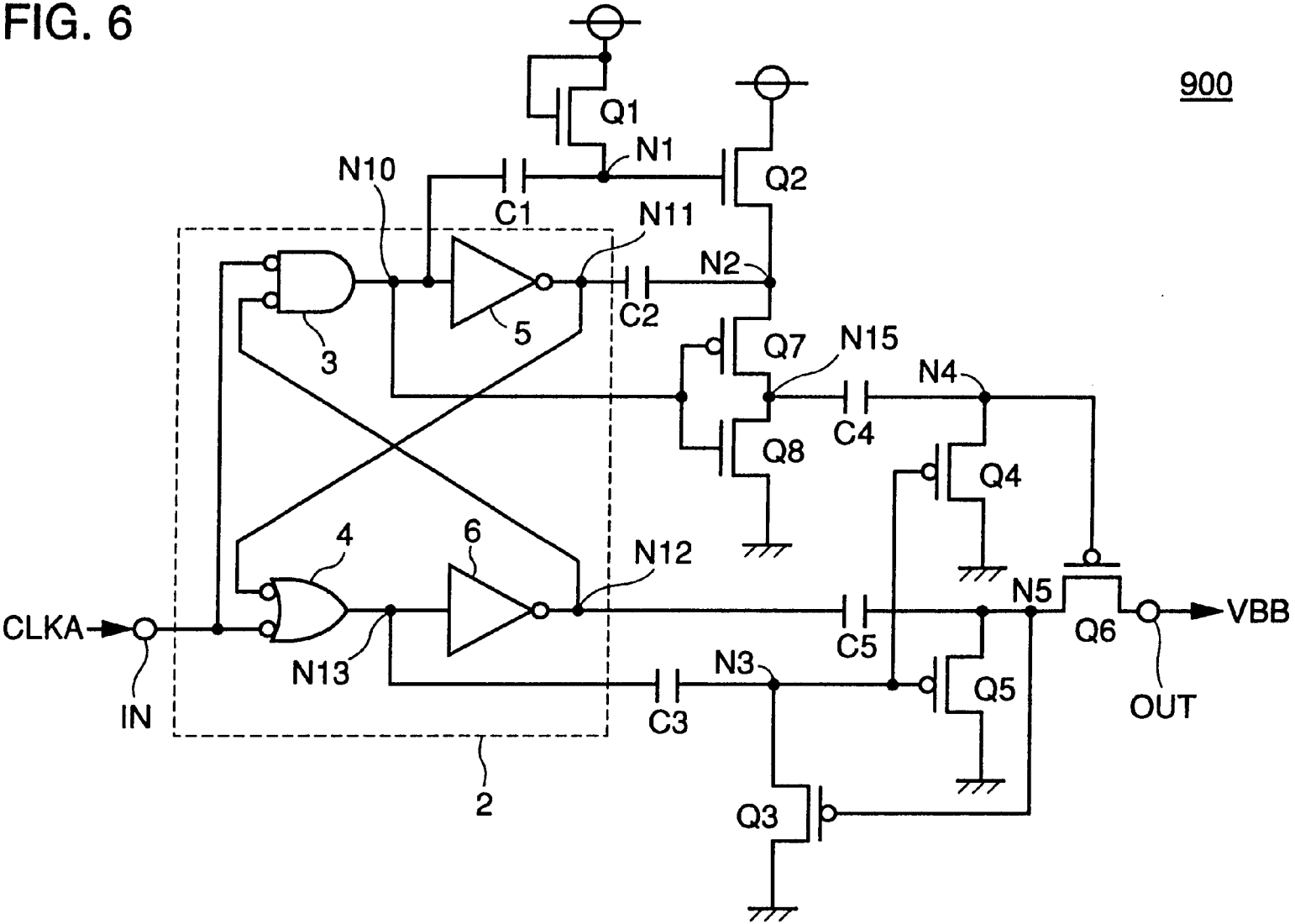
FIG. 6 shows an effect of a clamp circuit in charge pump circuit 100.

Charge pump circuit 900 shown in FIG. 6 lowers the gate voltage of output transistor Q6 to (−2VCC), and thereby increases the drive power. In this case, the maximum electric field intensity is equal to 2VCC/tox. For example, if power supply voltage VCC is 2.5 V and thickness tox of gate oxide film is 60 Å, capacity elements C4 and transistors Q4 and Q7 carry a voltage of 2VCC. In this case, the electric field has an intensity calculated from the following formula (1).

$$2VCC \div tox = 2 \times 2.5 \div 60\ \text{Å} \approx 8\ \text{MV/cm} \quad (1)$$

When the intensity of electric field applied to the channel of transistor reaches 6 MV/cm, carriers moving through the channel have an extremely high energy, and change into hot carriers. According to the circuit structure of charge pump circuit 900, therefore, hot carriers are generated as can be understood from formula (1), resulting in a problem relating to reliability.

According to the embodiment 1 of the invention, charge pump circuit 100 has the maximum electric field of (VCC+Vthq9)/tox. Therefore, by connecting the clamp transistor (transistor Q9) to a node boosted to a high voltage, increase in intensity of the maximum electric field can be suppressed.

As a result, it is possible to prevent generation of hot carriers even in the device employing the transistors which have thin gate oxide films, and therefore the reliability of the device can be improved. In the circuit of the embodiment, the gate electrode of output transistor Q6 carries a negative voltage lower than that on node N5 when charges are supplied to substrate voltage output node OUT. Therefore, a loss due to the threshold voltage of transistor Q6 is suppressed.

[Embodiment 2]

A semiconductor integrated circuit device and a substrate voltage generating circuit of an embodiment 2 of the invention will be described below with reference to FIG. 7. The semiconductor integrated circuit device of the embodiment 2 includes a charge pump circuit 200 shown in FIG. 7 instead of charge pump circuit 100 shown in FIG. 1.

Figure 7:
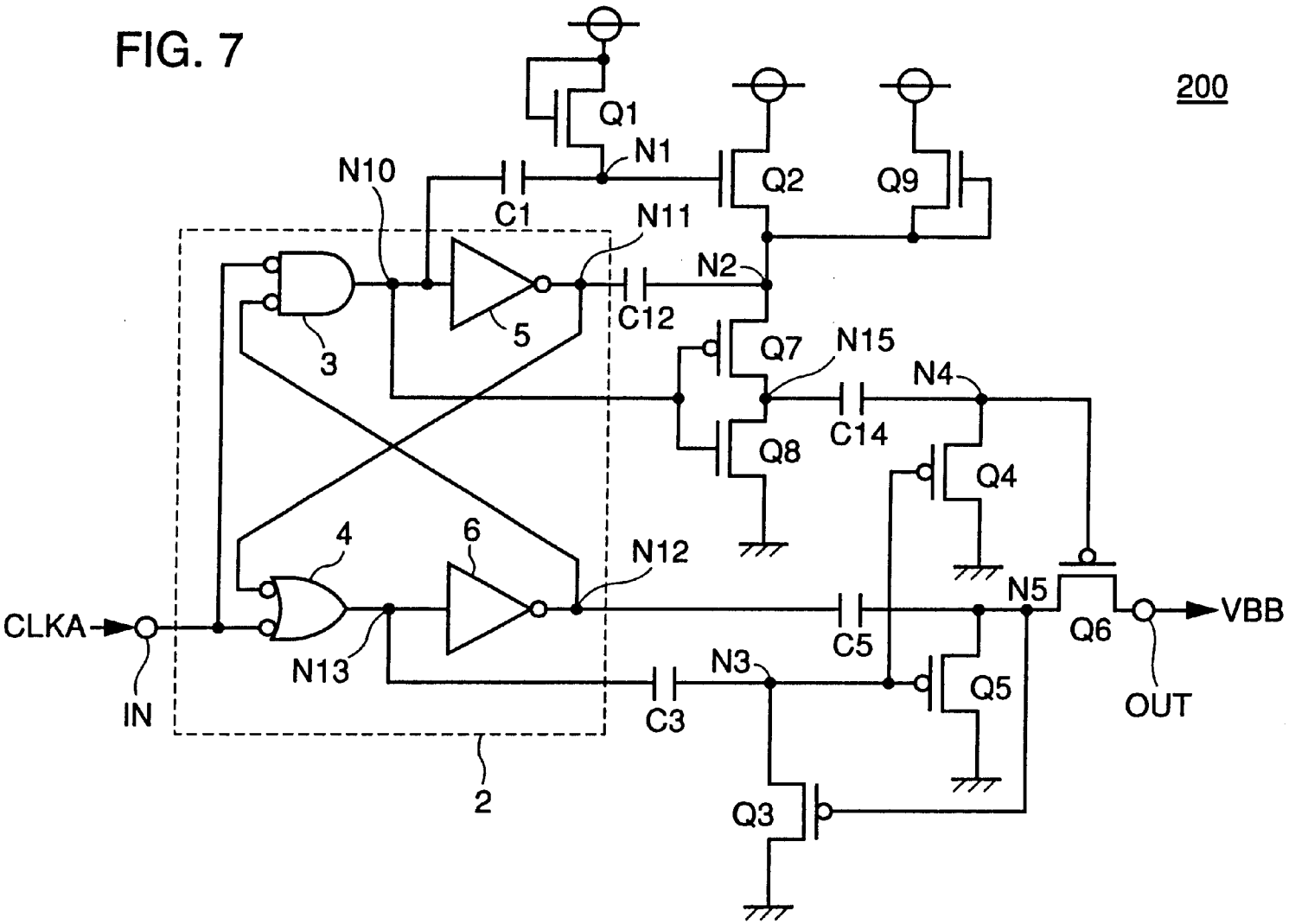
FIG. 7 shows by way of example a specific structure of a charge pump circuit 200 of an embodiment 2 of the invention.

Charge pump circuit 200 shown in FIG. 7 differs from charge pump circuit 100 in that capacity element C12 is employed instead of capacity element C2, and a capacity element C14 is used instead of capacity element C4.

In charge pump circuit 100, capacity element C2 has a capacity larger than that of capacity element C4 for boosting the voltage on node N2.

In contrast to this, charge pump circuit 200 according to the embodiment 2 of the invention, capacities of capacity elements, which are provided for controlling the gate voltage of output transistor Q6, are controlled. More specifically, a capacity ratio m of capacity element C12 with respect to capacity element C14 is lowered. Thereby, a width or degree by which the voltage on node N2 is boosted is kept low. The timing of pump operations of capacity elements C1, C3 and C14 is controlled by timing control circuit 2.

An operation of charge pump circuit 200 according to the embodiment 2 of the invention will be described below. When applied clock signal CLKA attains power supply voltage level VCC, transistor Q2 is turned on so that the voltage on node N2 attains power supply voltage level VCC. At this time, transistor Q8 is turned on, and capacity element C14 carries ground voltage GND.

When clock signal CLKA changes from power supply voltage level VCC to ground voltage level GND, capacity element C12 boosts the voltage on node N2 after turn-on of transistors Q7 and Q4. The voltage on node N4 is lowered by capacity element C14.

The following formula (2) expresses the quantity of charges, which are carried on node N2 when transistors Q7 and Q4 are on. In formula (2), a term "C" represents the capacity of capacity element C14, and a term "m" represents a capacity ration of capacity element C12 with respect to capacity element C14.

$$(m\times C)\times VCC+C\times VCC \tag{2}$$

The following formula (3) expresses a quantity of charges on node N2 which carries a voltage boosted by capacity element C12. In formula (3), a term "V2" represents the boosted voltage on node N2.

$$(m\times c)\times(V2-VCC)+C\times V2 \tag{3}$$

Since the quantity of charges is stored before and after the boosting, the results of formulas (2) and (3) are equal to each other. Accordingly, boosted voltage V2 on node N2 which is obtained from formulas (2) and (3) can be expressed by the following formula (4).

$$V2=(2m+1)VCC/(m+1) \tag{4}$$

In the case of m>1, i.e., in the case where the capacity of capacity element C12 is sufficiently larger than that of capacity element C14, boosted voltage V2 on node N2 is approximately equal to 2VCC.

In the case of m=1, i.e., in the case where the capacity of capacity element C12 is equal to that of capacity element C14, boosted voltage V2 on node N2 is equal to 1.5VCC. In this state, node N4 carries ground voltage GND or a voltage of −1.5VCC.

If m is smaller than 1 (m<1), boosted voltage V2 on node N2 is smaller than 1.5VCC (V2<1.5VCC). Thus, the amplitude of voltage on node N2 can be kept small by reducing capacity ratio m.

Owing to the above structure, it is possible to reduce an electric field applied to transistors in the charge pump circuit (more specifically, transistors Q4 and Q7 as well as MOS capacity element C14) because application of a high electric field can be prevented. Therefore, the reliability of operation can be ensured even if gate oxide film has a small thickness tox.

[Embodiment 3]

Figure 8:
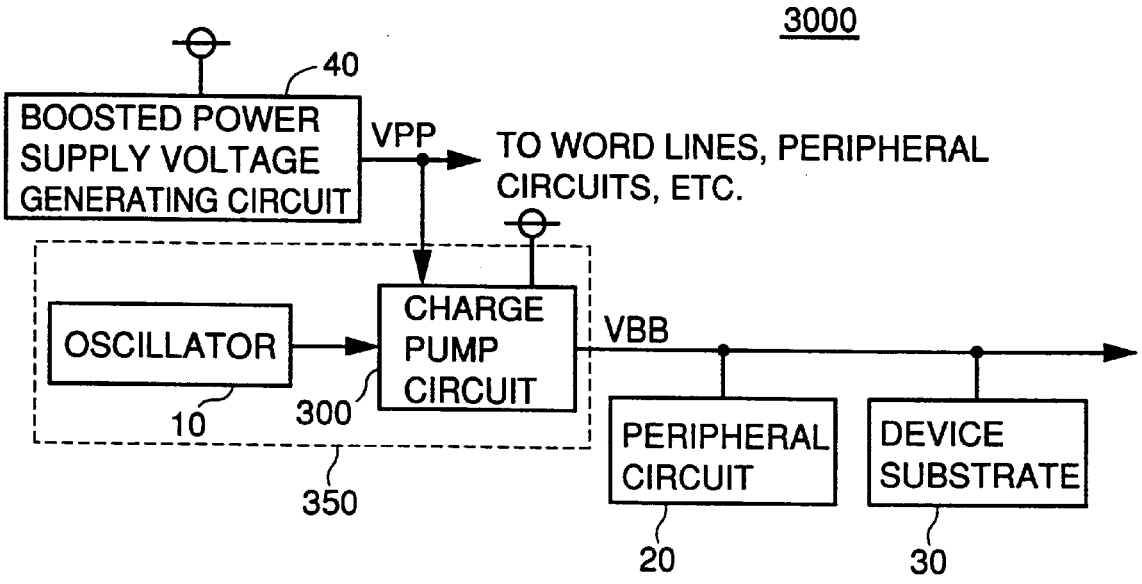
FIG. 8 is a block diagram showing a specific structure of a semiconductor integrated circuit device 3000 of an embodiment 3 of the invention.

A semiconductor integrated circuit device and a substrate voltage generating circuit according to an embodiment 3 of the invention will be described below with reference to FIG. 8. A semiconductor integrated circuit device 3000 shown in FIG. 8 includes a boosted power supply voltage generating circuit 40, a substrate voltage generating circuit 350, peripheral circuit 20 and device substrate 30.

Boosted power supply voltage generating circuit 40 boosts power supply voltage VCC to generate a boosted power supply voltage VPP, which is supplied, e.g., to word lines and peripheral circuits (not shown). Charge pump circuit 300 issues substrate voltage VBB by using boosted power supply voltage VPP issued from boosted power supply voltage generating circuit 40. Substrate voltage VBB issued from substrate voltage generating circuit 350 is supplied to peripheral circuit 20 and device substrate 30. 2VCC is larger than VPP (2VCC>VPP).

An example of a specific structure of charge pump circuit 300 shown in FIG. 8 will be described below with reference to FIG. 9. Charge pump circuit 300 in FIG. 9 includes timing control circuit 2, capacity elements C3–C5, transistors Q3–Q6 and VCC/VPP level changing circuit 50.

Figure 9:
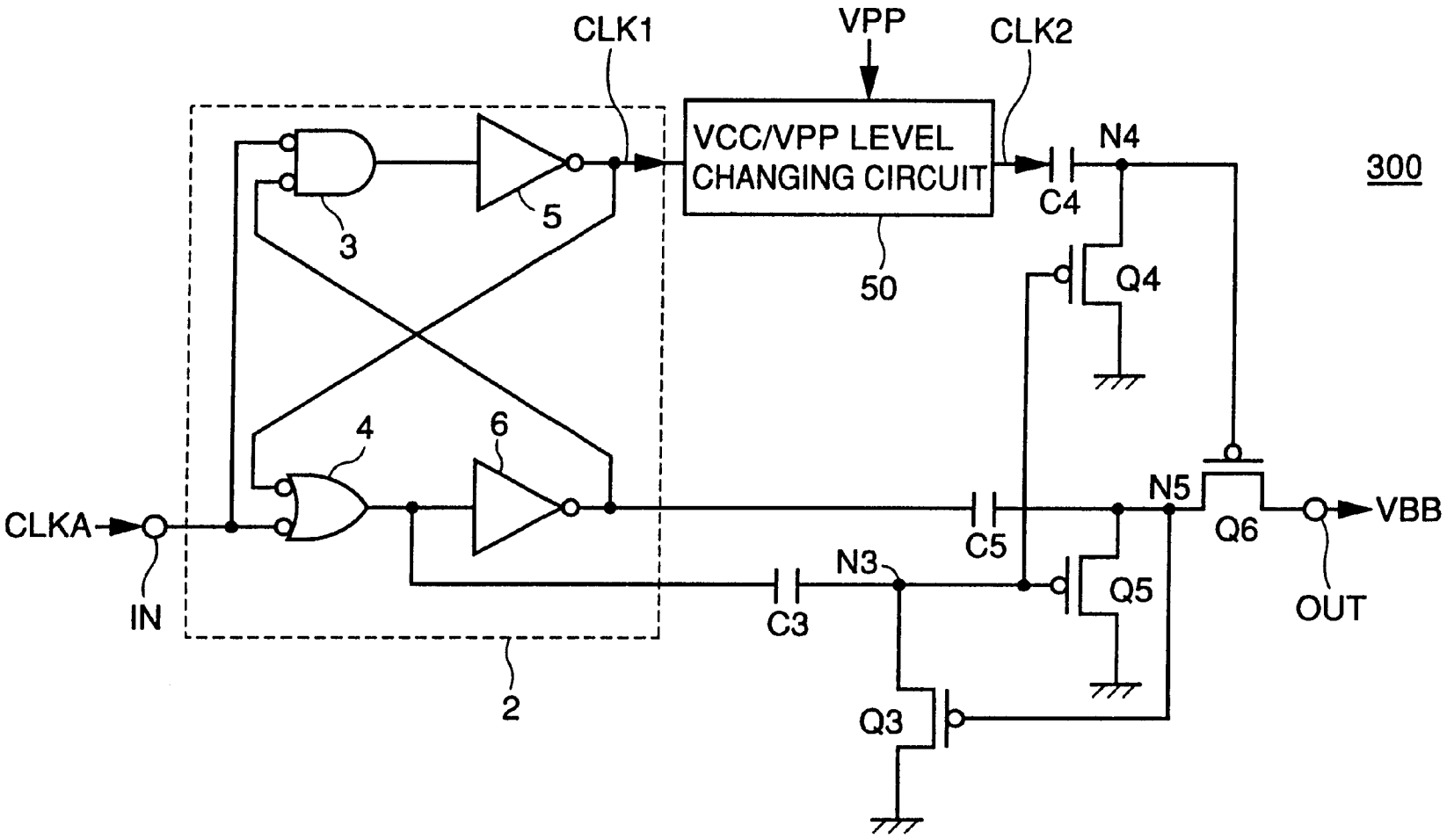
FIG. 9 shows by way of example a specific structure of a charge pump circuit 300 shown in FIG. 8.

Charge pump circuit 300 shown in FIG. 9 differs from charge pump circuit 100 in that VCC/VPP level changing circuit 50 is employed instead of transistors Q1, Q2, Q7, Q8 and Q9 as well as capacity elements C1 and C2.

VCC/VPP level changing circuit 50 changes a clock signal CLK1 (i.e., an output of inverter 5) of amplitude VCC into a clock signal CLK2 of an amplitude VPP. In charge pump circuit 300, clock signal CLK2 having amplitude of VPP and produced by VCC/VPP level converting circuit 50 is supplied to capacity element C4.

Figure 10:
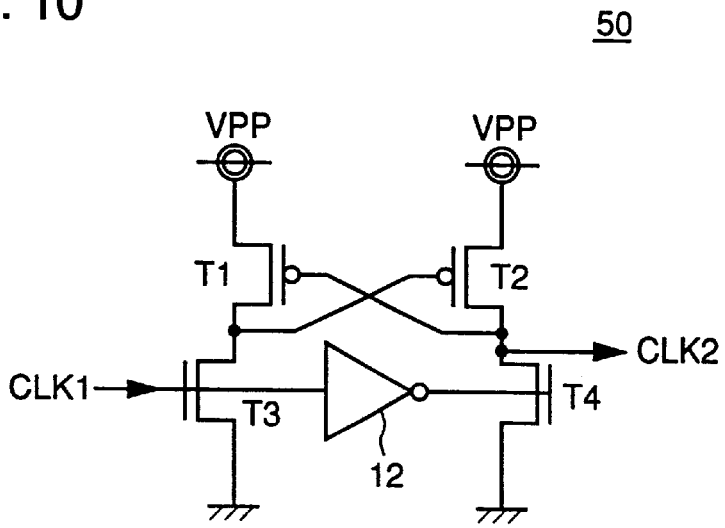
FIG. 10 is a circuit diagram showing a specific structure of a VCC/VPP level converting circuit 50 shown in FIG. 9.

An example of a specific structure of VCC/VPP level converting circuit 50 will be described below with reference to FIG. 10. VCC/VPP level converting circuit 50 includes PMOS transistors T1 and T2, NMOS transistors T3 and T4, and an inverter 12.

Transistors T1 and T3 are connected in series between boosted power supply voltage VPP and ground voltage GND. Transistors T2 and T4 are connected in series between boosted power supply voltage VPP and ground voltage GND. The gate electrode of transistor T1 is connected to a connection node formed between transistors T2 and T4. The gate voltage of transistor T2 is connected to a connection node formed between transistors T1 and T3.

Inverter 12 inverts clock signal CLK1 supplied thereto. The gate electrode of transistor T3 receives clock signal CLK1. The gate electrode of transistor T4 receives the output of inverter 12. Clock signal CLK2 is sent from the connection node between transistors T2 and T4.

When clock signal CLK1 is at ground voltage level GND, transistors T4 and T1 are on, transistors T3 and T2 are off, and clock signal CLK2 is at ground voltage level GND. When clock signal CLK1 is at power supply voltage level VCC, transistors T2 and T3 are on, transistors T1 and T4 are off, and clock signal CLK2 is at boosted power supply voltage level VPP.

Thereby, capacity element C4 can perform the pump operation with clock signal CLK2 of amplitude VPP. When boosted power supply voltage VPP is placed on capacity element C4 and transistor Q4 is turned on, node N4 is clamped to ground voltage GND.

When transistor Q4 is turned on and ground voltage GND is placed on capacity element C4, node N4 carries a voltage of (−VPP). Since the gate voltage of output transistor Q6 takes the sufficiently negative value of (−VPP), the potential on node N5 is supplied to substrate voltage output node OUT.

If capacity elements are used to boost power supply voltage VCC (e.g., in charge pump circuit 900 shown in FIG. 6), it may be boosted to an excessively high level if power supply voltage VCC rises due to change in external power supply voltage level.

In contrast to this, charge pump circuit 300 according to the embodiment 3 of the invention does not boost power supply voltage VCC so that the boosted level is not affected by change in power supply voltage. Accordingly, the boosted level is constant (VPP) even when power supply voltage VCC changes, and a high electric field is not applied to the transistors.

The maximum electric field in charge pump circuit 300 is equal to (VPP/tox), and therefore can be lower than the maximum electric field of (2VCC/tox) in charge pump circuit 900. Accordingly, even in the structure employing transistors which have gate oxide films of small thicknesses tox, generation of hot carriers can be suppressed and the intended reliability can be ensured.

[Embodiment 4]

A semiconductor integrated circuit device and a substrate voltage generating circuit according to an embodiment 4 of the invention will be described below with reference to FIG. 11.

Figure 11:
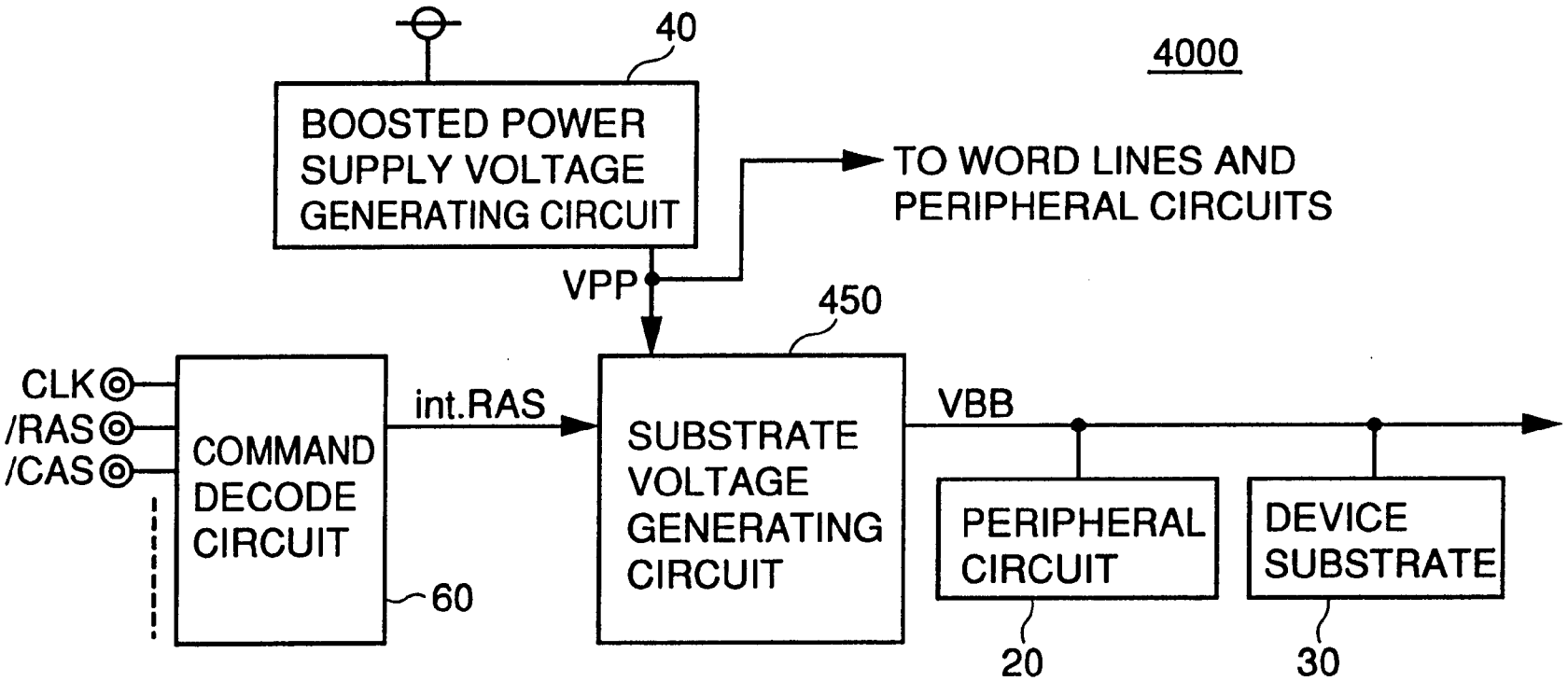
FIG. 11 is a block diagram showing a structure of a major portion of a semiconductor integrated circuit device 4000 of an embodiment 4 of the invention.

Referring to FIG. 11, semiconductor integrated circuit device 400 includes a command decode circuit 60, a substrate voltage generating circuit 450, peripheral circuit 20 and device substrate 30.

Command decode circuit 60 receives external signals (external clock signal CLK, external row address strobe signal /RAS, external column address strobe signal /CAS and others) and issues corresponding internal signals. Substrate voltage generating circuit 450 generates substrate voltage VBB in accordance with an internal row address strobe signal int.RAS issued from command decode circuit 60. Peripheral circuit 20 and device substrate 30 operate based on substrate voltage VBB supplied from substrate voltage generating circuit 450.

A structure of substrate voltage generating circuit 450 shown in FIG. 11 will be described below with reference to FIG. 12.

Figure 12:
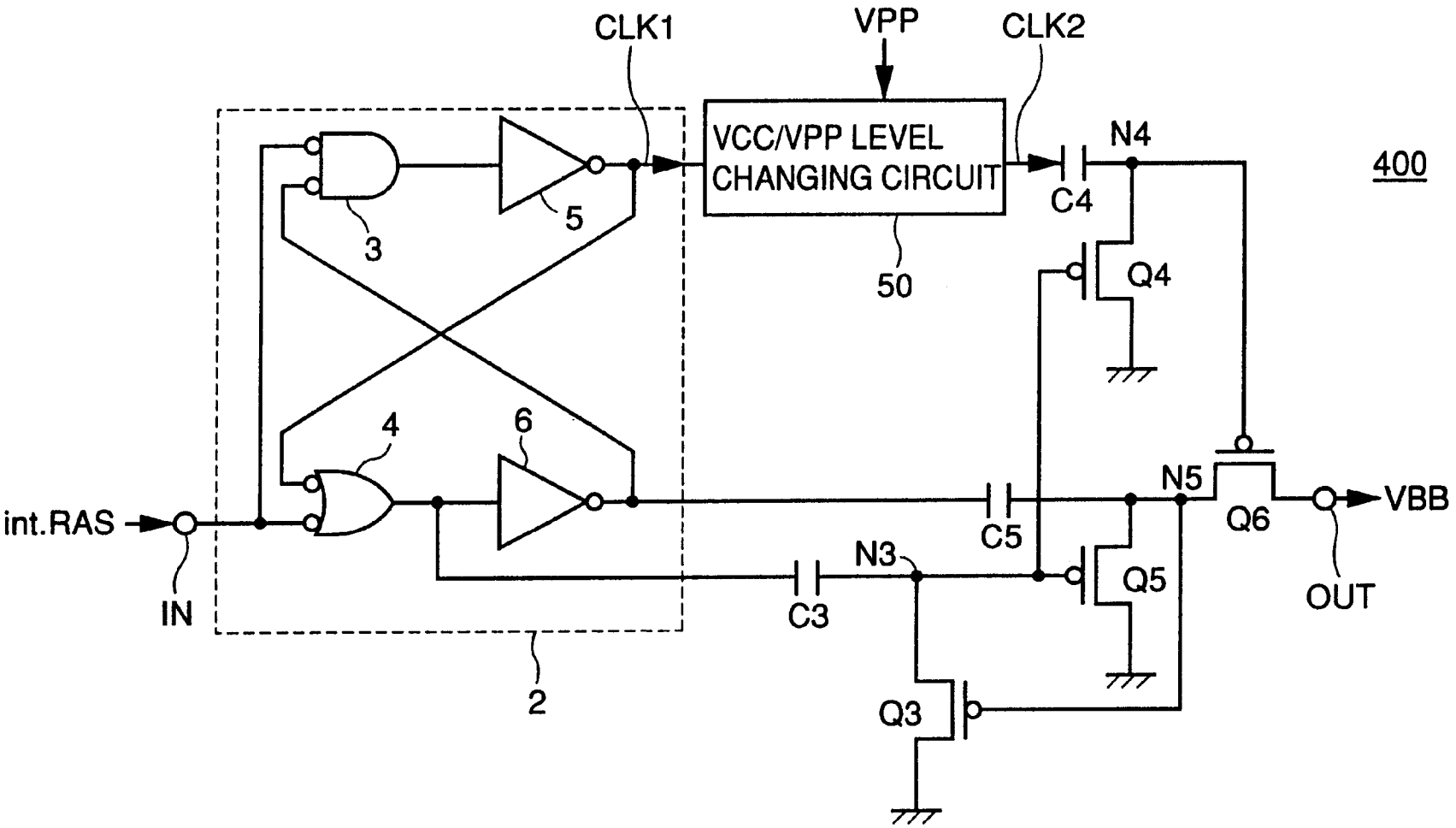
FIG. 12 shows by way of example a specific structure of a charge pump circuit 400 included in a substrate voltage generating circuit 450 shown in FIG. 11.

Substrate voltage generating circuit shown in FIG. 11 includes a RAS charge pump circuit 400 shown in FIG. 12. RAS charge pump circuit 400 receives internal row address strobe signal int.RAS sent from command decode circuit 60, and repeats the pump operation to generate substrate voltage VBB. RAS charge pump circuit 400 operates every time external row address strobe signal /RAS is supplied.

RAS charge pump circuit 400 includes timing control circuit 2, capacity elements C3–C5, transistors Q3–Q6 and VCC/VPP level changing circuit 50. These are connected in the same manner as those of the embodiment 3.

Logic gates 3 and 4 included in timing control circuit 2 receive internal row address strobe signal int.RAS. VCC/VPP level converting circuit 50 changes the output of inverter 5, i.e., clock signal CLK1 into clock signal CLK2 of amplitude VPP in response to internal row address strobe signal int.RAS. Capacity element C4 receives clock signal CLK2 of amplitude VPP.

When external row address strobe signal /RAS is externally supplied, the device is activated, and substrate voltage VBB is consumed. RAS charge pump circuit 400 operates for complementing consumed substrate voltage VBB.

For example, it is now assumed that charge pump circuit 900 shown in FIG. 6 is supplied, as clock signal CLKA, with internal row address strobe signal int.RAS. When the device enters the standby state after input of internal row address strobe signal int.RAS, node N2 enters the standby state in which it carries the boosted voltage of 2VCC. When the standby state continues, capacity element C2 is gradually discharged, and the voltage level on node N2 starts to lower. When the voltage on node N2 lowers in this manner, the amplitude of clock signal applied to capacity element C4 lowers. Therefore, output transistor Q6 cannot be sufficiently turned on, and charges on node N5 cannot be supplied to substrate voltage output node OUT in some cases.

In contrast to this, RAS charge pump circuit 400 according to the embodiment 4 of the invention uses boosted power supply voltage VPP for controlling the pump operation of capacity element C4. Therefore, discharging of capacity element C4 can be ignored (i.e., charging exerts no influence).

Even if the standby state continues for a long term after internal row address strobe signal int.RAS is supplied to RAS charge pump circuit 400, substrate voltage VBB can be efficiently generated. A signal such as external column address strobe signal /CAS which is not supplied during standby may be effectively used as the clock signal which drives RAS charge pump circuit 400.

Figure 13:
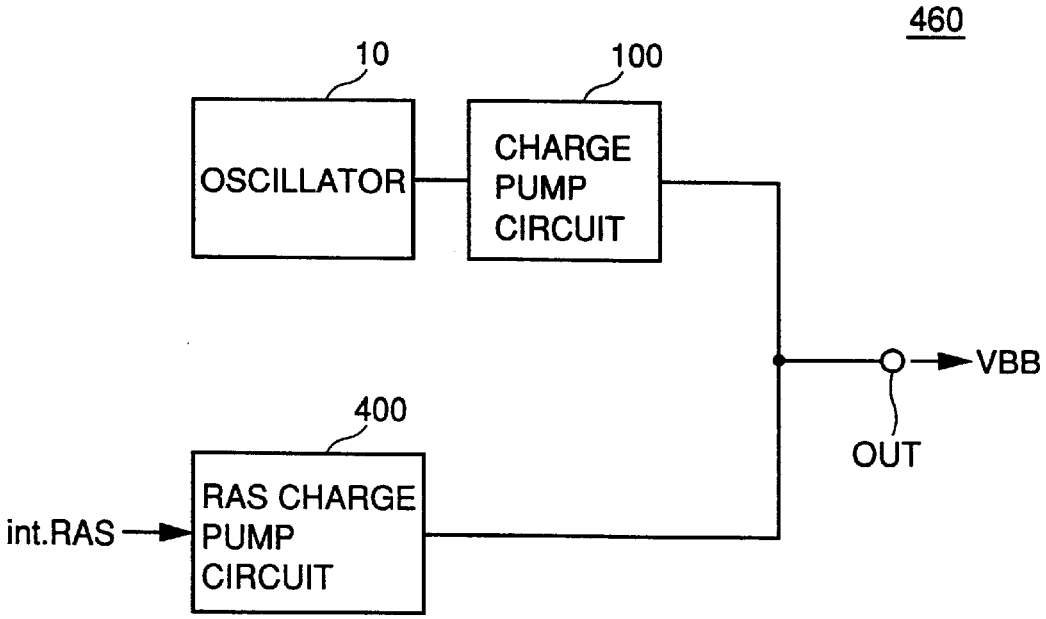
FIG. 13 shows another structure of the substrate voltage generating circuit of the embodiment 4 of the invention.
Figure 14:
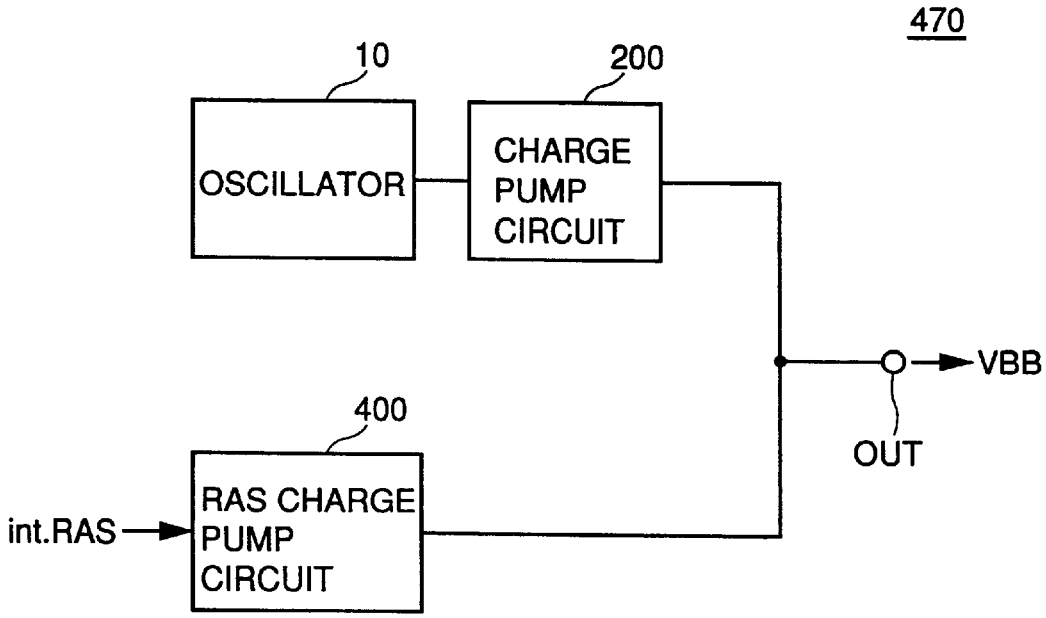
FIG. 14 shows still another structure of the substrate voltage generating circuit of the embodiment 4 of the invention.
Figure 15:
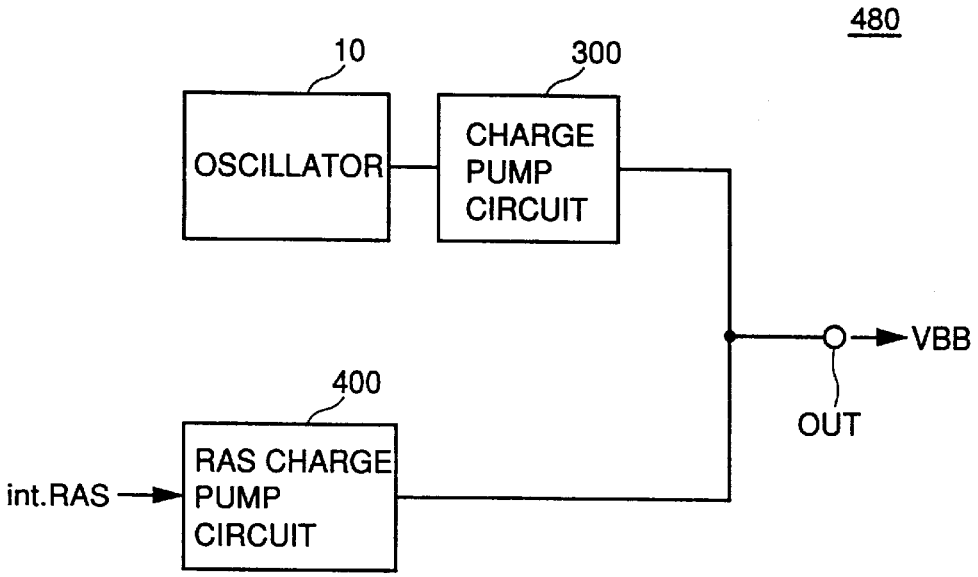
FIG. 15 shows yet another structure of the substrate voltage generating circuit of the embodiment 4 of the invention.
Figure 16:
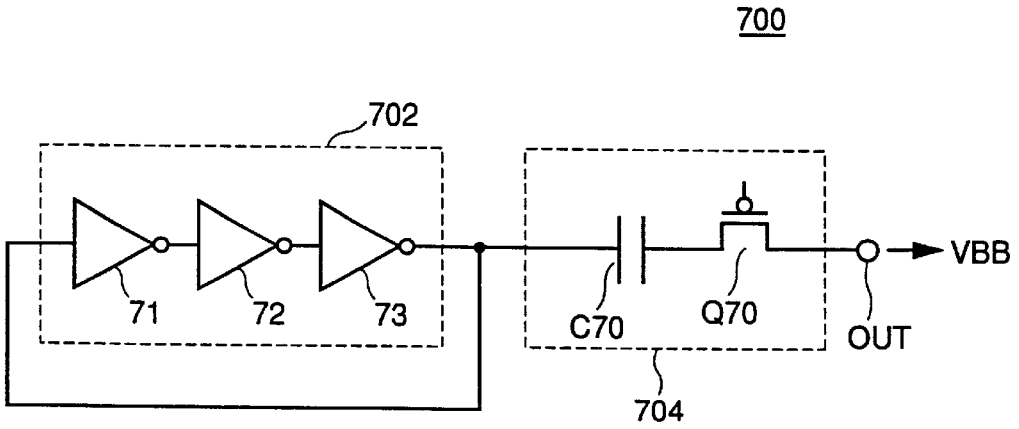
FIG. 16 PRIOR ART
FIG. 16 shows a structure of a substrate voltage generating circuit 700 in the prior art.

Other examples of the structure of the substrate voltage generating circuit according to the embodiment 4 of the invention will be described below with reference to FIGS. 13 to 15. A substrate voltage generating circuit 460 shown in FIG. 13 includes oscillator 10, RAS charge pump circuit 400 and charge pump circuit 100. A substrate voltage generating circuit 470 shown in FIG. 14 includes oscillator 10, RAS charge pump circuit 400 and charge pump circuit 200. A substrate voltage generating circuit 480 shown in FIG. 15 includes oscillator 10, RAS charge pump circuit 400 and charge pump circuit 300. Each of charge pump circuits 100, 200 and 300 is coupled to RAS charge pump circuit 400 via substrate voltage output node OUT.

Charge pump circuit 100, 200 or 300 which always operates with a low power is combined with RAS charge pump circuit 400 which operates only when the chip requires a large supply current.

When the chip is on standby, charge pump circuit 100, 200 or 300 requiring a low power operates. RAS charge pump circuit 400 supplies a large current commensurate with the large substrate current which is generated during accessing, and generates predetermined negative voltage (substrate voltage) VBB. Owing to this structure, an intended substrate voltage can be generated using a low power supply voltage, and an influence on the transistors can be reduced so that the intended reliability can be ensured.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A substrate voltage generating circuit comprising:

a voltage output terminal issuing a substrate voltage;

a voltage supply circuit for supplying a voltage to said voltage output terminal in response to a clock signal;

a switch circuit arranged between said voltage supply circuit and said voltage output terminal and being turned on/off in response to a signal on a first node;

a boosting circuit boosting a voltage on a second node in response to said clock signal;

a drive circuit including a first capacity element arranged between said first and second nodes and supplying charges to said first node; and a clamp circuit for rendering voltage on said second node lower than a constant value associated with the clamp circuit.

2. The substrate voltage generating circuit according to claim 1, wherein said clamp circuit includes a transistor diode-connected between said second node and a power supply voltage.

3. The substrate voltage generating circuit according to claim 2, wherein said switch circuit includes a transistor having a gate connected to said first node.

4. A substrate voltage generating circuit comprising:

a voltage output terminal issuing a substrate voltage;

a voltage supply circuit for supplying voltage to said voltage output terminal in response to a clock signal having an amplitude corresponding to a power supply voltage;

a switch circuit arranged between said voltage supply circuit and said voltage output terminal; and a drive circuit including:

a converting circuit for converting the clock signal having the amplitude corresponding to said power supply voltage into a clock signal having an amplitude corresponding to a boosted power supply voltage produced by boosting said power supply voltage, and a capacity element receiving the clock signal having the amplitude corresponding to said boosted power supply voltage, and provided for turning on/off said switch circuit based on a pump operation of said capacity element, wherein said switch circuit includes a first PMOS transistor, said capacity element is arranged between an output node of said converting circuit and a gate electrode of said first PMOS transistor, said drive circuit further includes a second PMOS transistor connected between the gate electrode of said first PMOS transistor and the ground voltage, and being turned on/off in response to said clock signal having the amplitude corresponding to said power supply voltage, and said boosted power supply voltage is smaller than double the power supply voltage.

5. A semiconductor integrated circuit device comprising:

a clock generating circuit for generating a clock signal;

a voltage output terminal issuing a substrate voltage;

a voltage supply circuit for supplying a voltage to said voltage output terminal in response to said clock signal;

a switch circuit arranged between said voltage supply circuit and said voltage output terminal and being turned on/off in response to a signal on a first node;

a boosting circuit boosting a voltage on a second node in response to said clock signal;

a drive circuit including a first capacity element arranged between said first and second nodes and supplying charges to said first node; and a clamp circuit for clamping the voltage level on said second node, wherein said clamp circuit includes a transistor diode-connected between said second node and a power supply voltage.

6. A substrate voltage generating circuit comprising:

a voltage output terminal issuing a substrate voltage;

a voltage supply circuit for supplying a voltage to said voltage output terminal in response to a clock signal;

a switch circuit arranged between said voltage supply circuit and said voltage output terminal and being turned on/off in response to a signal on a first node;

a driving circuit including:

a first capacity element supplying charges to a second node, a converter supplied with a voltage on said second node and a ground voltage, converting a potential of said clock signal, and a second capacity element supplying charges to said first node and having a capacity larger than said first capacity element.

7. The substrate voltage generating circuit according to claim 6, wherein said switch circuit includes a transistor having a gate connected to said first node.

8. The substrate voltage generating circuit according claim 7, wherein said converter includes:

a PMOS transistor connected between said second node and a third node, and being turned on/off in response to said clock signal; and an NMOS transistor connected between said third node and said ground voltage, and being turned on/off in response to said clock signal, and said second capacity element is connected between said third node and said first node.

9. The substrate voltage generating circuit according to claim 7, wherein said driving circuit further includes a transistor connected between a power supply voltage and said second node, and being turned on/off in response to said clock signal.

10. The substrate voltage generating circuit according to claim 7, wherein said driving circuit further includes a transistor connected between a ground voltage and said first node, and being turned on/off in response to said clock signal.

11. The semiconductor integrated circuit according to claim 5, wherein said drive circuit further includes:

a PMOS transistor connected between said second node and a third node, and being turned on/off in response to said clock signal; and an NMOS transistor connected between said third node and a ground voltage, and being turned on/off in response to said clock signal, and said first capacity element is connected between said third node and said first node.

12. The semiconductor integrated circuit according to claim 5, wherein said boosting circuit includes a second capacity element supplying changes to said second node in response to said clock signal.

13. The semiconductor integrated circuit according to claim 12, wherein said second capacity element has a capacity larger than said first capacity element.

14. The semiconductor integrated circuit according to claim 12, wherein said boosting circuit further includes a transistor connected between a power supply voltage and said second node, and being turned on/off in response to said clock signal.

15. The semiconductor integrated circuit according to claim 5, wherein said driving circuit further includes a transistor connected between a ground voltage and said first node, and being turned on/off in response to said clock signal.

* * * * *